US008578742B2

(12) United States Patent
Shulman

(10) Patent No.: US 8,578,742 B2
(45) Date of Patent: Nov. 12, 2013

(54) CONFORMAL AUTOMATED WRIST RESTRAINT AND METHOD OF USE

(76) Inventor: Burt H. Shulman, Wappingers Falls, NY (US)

( * ) Notice: Subject to any disclaimer, the term of this patent is extended or adjusted under 35 U.S.C. 154(b) by 232 days.

(21) Appl. No.: 13/236,015

(22) Filed: Sep. 19, 2011

(65) Prior Publication Data

US 2012/0118027 A1 May 17, 2012

Related U.S. Application Data

(60) Provisional application No. 61/458,044, filed on Nov. 17, 2010.

(51) Int. Cl.
*E05B 75/00* (2006.01)

(52) U.S. Cl.
USPC ..... 70/16; 254/278; 254/279; 254/282; 254/290

(58) Field of Classification Search
USPC ..... 70/16, 15, 17, 19, 279.1; 119/802, 803, 119/857; 128/878, 879; 74/25; 254/278, 254/279, 282, 290
See application file for complete search history.

(56) References Cited

U.S. PATENT DOCUMENTS

| | | | | |
|---|---|---|---|---|
| 3,545,237 | A | 12/1970 | Thompson | 70/16 |
| 4,854,138 | A | 8/1989 | Charland | 70/16 |
| 4,972,784 | A * | 11/1990 | Ing-Hsiang | 109/3 |
| 5,099,662 | A * | 3/1992 | Tsai | 70/16 |
| 5,412,963 | A * | 5/1995 | Carlo et al. | 70/209 |
| 5,443,155 | A | 8/1995 | Robinson | 206/223 |
| 6,026,661 | A * | 2/2000 | Spiropoulos | 70/16 |
| 6,379,206 | B1 * | 4/2002 | Wallasch | 441/80 |
| 7,000,439 | B2 | 2/2006 | DiDomenico | 70/16 |
| 7,207,279 | B2 * | 4/2007 | Fu et al. | 109/3 |
| 7,866,321 | B2 | 1/2011 | DePetrillo | 128/878 |
| 2002/0100830 | A1 * | 8/2002 | Sasaki et al. | 242/332.4 |
| 2002/0166350 | A1 * | 11/2002 | MacAleese et al. | 70/16 |
| 2005/0193782 | A1 * | 9/2005 | Beane et al. | 70/16 |
| 2006/0272366 | A1 * | 12/2006 | Kim et al. | 70/16 |
| 2008/0173048 | A1 * | 7/2008 | Kim et al. | 70/16 |
| 2009/0211316 | A1 * | 8/2009 | Butler et al. | 70/16 |
| 2010/0031709 | A1 * | 2/2010 | Kim et al. | 70/16 |
| 2012/0222457 | A1 * | 9/2012 | Kriesel et al. | 70/16 |

* cited by examiner

*Primary Examiner* — Lloyd Gall
(74) *Attorney, Agent, or Firm* — Walter J. Tencza, Jr.

(57) ABSTRACT

An automated wrist restraint system providing a safe and simple device to immobilize a suspect. A conformal flexible band is employed in a loop configuration, to allow, in the open position, the entry of the largest sized hand encountered in the field. In the closed position the band conforms to the geometry of the wrist to minimize contact forces and prevent wrist injury. Additionally, a microprocessor, controlled servomechanism opens, closes and slackens the band to further prevent wrist injury. A simply activated, holster worn, radio transmitter allows the operator to remotely activate the system, while maintaining a safe distance from the suspect. Among the many possibilities contemplated, the system may be fitted to a law enforcement vehicle, or a robot.

24 Claims, 10 Drawing Sheets

2c
D1
2b
26a
2a 46
40
42
26a
41
40
W1

A4
K2
45
A3
44
M1
43
A2
40
26a
K1
A1

FIG. 5A
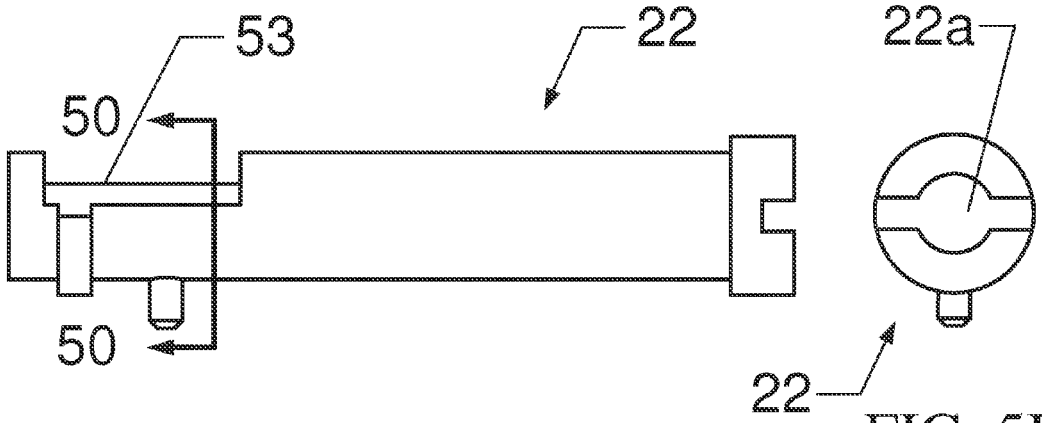
FIG. 5B
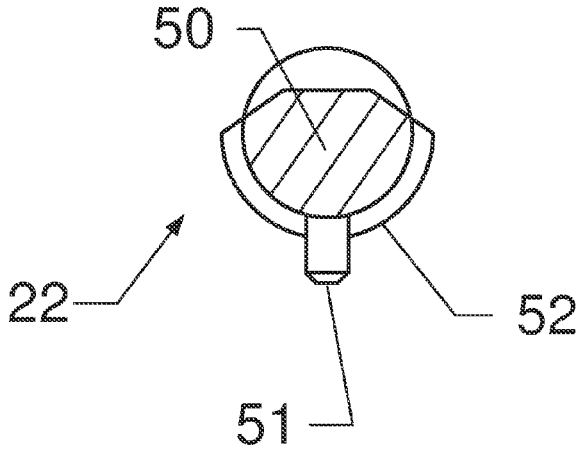
FIG. 5C

CONFORMAL AUTOMATED WRIST RESTRAINT AND METHOD OF USE

CROSS REFERENCE TO RELATED APPLICATION(S)

The present patent application claims the priority of U.S. provisional patent application Ser. No. 61/458,044 filed on Nov. 17, 2010, inventor and applicant Burt H. Shulman.

FIELD OF THE INVENTION

This invention relates to automated means of temporarily restraining a person and methods of applying such means.

BACKGROUND OF THE INVENTION

The restraining of a person by use of a manually applied restraint device, such as a handcuff or manacle, is well known. These restraint devices are used, for instance by a law officer, in order to render a suspect harmless. These restraint devices and method of application have inherent deficiencies. They require the officer to have his hands free (of weapons, searchlight, etc.) in order to successfully apply the restraint device. During this time, the officer's attention must be focused on the task and taken away from other activities, such as monitoring and controlling other suspects at the scene. Additionally, the close proximity of the officer to the suspect, gives the suspect the opportunity to make contact with the officer to inflict injury.

An appendage restraint device has been disclosed in U.S. Pat. No. 3,545,237 by Thompson. This device uses conventionally shaped arcuate, metal manacles that are mechanically positioned in an opened and closed state by an electric motor, gear, and clutch mechanism. In the closed position, the manacles contact the suspect's wrists and apply a constant compression force. This is not a currently approved method of restraint, due to possible wrist injury.

Further, the manacles are operated by switches located near the manacles. Although this distance provides some protection from assault, it restricts the proper positioning and movement of the officer, which increases the risk for assault by the suspect or may facilitate his escape. This restraint device is described as being mounted to the outside of a police vehicle, where it is unprotected with respect to environmental contaminants. Ingress of dirt, water, snow or ice would thus impede its operation. Additionally, the arcuate manacles do not readily lend themselves to being covered by a protective bellows or boot.

Another appendage restraint system, disclosed in U.S. Pat. No. 7,000,439 by DiDimenico, provides for a manacle closed by magnetic attraction. That magnetic closure means introduces several distinct disadvantages. The magnetic forces are relatively weak in the initial closing position (pole pieces are far apart) and produce an extremely high closing force in the closed position. This force would be sufficient to cause wrist injury. Additionally, the fixed wrist aperture width would not restrain the smallest hand, when dimensioned to allow the passage of the largest hand that would be encountered in the field. In some instances, continuous contact with the wrist would be made and this would be in violation of commonly accepted handcuffing safety protocol. This restraint mechanism is also slated to be affixed to an outside of a vehicle and exposed to environmental contaminants. Its structure does not readily allow the use of a protective covering.

A bladder system and inflation means embodiment is also contemplated to alleviate some of these problems, in that the height and width dimensions of the aperture are now adjustable, but contact with the wrist must still be made and maintained in order to provide restraint. Additionally, the fluid filled bladders do not provide sufficient rigidity in the pullout direction, to prevent escape. A radio transmitter link is an improvement to the Thompson patent for obvious reasons. It is, however, unnecessarily complex with a plurality of control buttons, thus making it difficult and distracting to operate effectively, by the officer in the field.

Further, the restraint system described by DiDimenico, as there is no fault detection inherent in the design, requires a direct monitoring and action by the operator or officer, who is typically at a remote location. He thus is unable, in most circumstances, to carefully monitor each stage of the restraint activity. A fault condition may occur during opening or closing of the restraint and remedial action, by the operator may, be delayed or not occur, which may be injurious to the suspect.

In view of the foregoing, it is clear that there is still a need to provide an improved wrist restraint device, which can restrain and release an individual's wrists of various sizes, without injury, with minimal operator interaction, with adaptability to various restraint, and release methods and maintain its functionality in harsh environments.

SUMMARY OF THE INVENTION

One or more embodiments of the present claimed invention comprises several components to accomplish a, safe, easy to use, adaptable and, environmentally protected, automated wrist restraint. One component is an electromechanical mechanism that provides noninjurious restraint to wrists of various sizes, typically of human beings, encountered in the field. More than one such mechanism may be employed in the restraint system, to restrain multiple wrists. Electronic controls are included comprising a microprocessor and a regulated electric power supply, which provide a controlled opening and closing of said restraint mechanism, to prevent injury. A radio receiver, activated by an easy to use portable transmitter, is connected to the system to provide remote activation with minimal operator interaction. Bellows, boots, an housing, and an enclosure are included to prevent the deleterious effects of environmental contamination on the various internal components.

As used herein, the term "conformal" means a surface contour created by a low force distortion of the band, in response to contact with the wrist's peripheral geometry. As used herein, such terms as "retracted, wound, and closed" are used to indicate a state of the conformal band, when causing restraint. As used herein, such terms as "extended, unwound, and opened" are used to indicate a state of the conformal band, when not causing restraint. As used herein, the term "longitudinal", refers to a direction parallel to a length of the band. As used herein, the term "transverse", refers to a direction parallel to a width of the band. As used herein the term "normal", refers to a direction parallel to a thickness of the band. As used herein, the phrase law officer is used to denote the operator of the restraint device, in some circumstances. The operator may also be referred to as an officer, meaning any official. As used herein, the term "suspect" is used to describe a human being who is to be restrained. In at least one embodiment of a restraint and release method and/or apparatus, multiple suspects may be restrained. As used herein, the term "loop" is used to describe the open space formed and bounded by the portion of a band, external to the restraint device, which is arched, between the wrist receiving saddle's wrist contacting surfaces. The position, motion and speed of a loop is that of the arched band portion of said loop.

It is understood that the restraint of a wrist is accomplished by the fact that the wrist of a suspect has a smaller characteristic diameter than the hand of that suspect. In the preferred embodiments of the present invention, a flexible band, is employed to surround and restrain the wrist of a suspect. The use of such a flexible band, allows a loop to be created of a diameter necessary to pass the largest hand, with the ability to reduce the loop diameter to prevent removal of the smallest hand, encountered in the field. Another advantage of the band is that it is inherently flexible (conformal) in the normal direction, while relatively inflexible in the transverse (pull-out) direction, thus preventing unwanted removal of the wrist. An electric motor driven reel subassembly is designed to create a loop of varying diameters of said band, as well as, provide a compact storage of said band. Additionally, the reel's rotary angular position is absolutely encoded to provide feedback, to a microprocessor, to achieve the required loop diameters during operation. The microprocessor and program determine the loop's fully opened, fully closed and intermediate (slack) positions.

Another aspect of one or more embodiments of the claimed invention is the elimination of wrist injury. This may be accomplished by several means. First, is the inherent conformal nature of the band. During operation, the band is retracted, until the loop contacts the wrist. The band conforms to the particular wrist shape, including any interfering objects, such as a wrist watch. This conformation distributes the closing force, uniformly, and eliminates force concentrations and pinch points, which could cause wrist injury. In conjunction with this effect, the controlled limitation of motor drive torque, limits tightening forces, so they are non-injurious to the suspect.

Yet another means employed by one or more embodiments of the claimed invention, to eliminate wrist injury, is real time sensing of the moment of impingement of the loop against the wrist. Such sensing is achieved by monitoring the angular position of the reel subassembly and detecting a "low reel speed" condition. This occurs when the tightening force, around the wrist, is near the controlled limit of the driving motor torque. When "low reel speed" is detected, by the microprocessor, a reverse signal is applied to the motor, subsequently reversing the reel direction and increasing the loop diameter a preset amount (slack), such that the loop is not in intimate contact with the wrist.

A further advantage of flexible bands for use in one or more embodiments of the present invention is that it readily allows the use of a protective bellows and boot, thus rendering the entire mechanism water resistant and easily cleared of mud, snow, or ice.

Yet another aspect of one or more embodiments of the claimed invention is a radio transmitter, which may be small, portable and may have one system control button, which is depressed by an operator, as each step in a restraint and release method, in accordance with one or more embodiments is taken. A simple control method in accordance with one or more embodiments allows complete operator's attention to be paid to the suspect, as well as, allowing defensive and offensive enforcement devices (weapons, searchlight) to be operated concurrently.

Yet another aspect of one or more embodiments of the claimed invention is an apparatus with a readily adaptable physical configuration and compact design, such that it can be mounted on and utilized with a robot, such as a law enforcement robot or military automated guided vehicle. It is currently known that a robot can be used for remote surveillance, communication and can also deploy lethal and non-lethal weapons. Presently, however, when a suspect is to be restrained, previously protected personnel are typically used to apply standard handcuffs, exposing them to the dangers of such activities, as mentioned above.

Yet another aspect of one or more embodiments of the claimed invention is the use of a microprocessor to control and monitor the restraint and release of a suspect or suspects. This allows a restraint device of one or more embodiments of the claimed invention to be readily adaptable to various restrain and release methods, including restraining and releasing multiple suspects, at the same time or coordinating activities of a restraint device of one or more embodiments to the movement and activities of a robot, all with minimal human operator interaction and distraction. Another advantage of using a microprocessor to control the operation of restraint mechanisms of one or more embodiments of the present invention is that all steps in a restraint and release method in one or more embodiments can be monitored in real time, by the microprocessor, for fault conditions and immediate remedial action can be taken to minimize or prevent injury to a suspect.

Various objects, features, aspects, and advantages of one or more embodiments of the claimed invention will become more apparent from the following detailed description of one or more embodiments, including one or more preferred embodiments of the claimed invention, along with the accompanying drawings.

BRIEF DESCRIPTION OF THE DRAWINGS

FIG. 5A is a side, elevational view, indicating a cross sectional view of FIG. 5C, of an emergency release cam, for use with the restraint device of FIG. 1;

FIG. 5B is a side, elevational view of the emergency release cam of FIG. 5A for use with the restraint device of FIG. 1;

FIG. 5C is a partly cross-sectional, front elevational view of the emergency release cam of FIG. 5A for use with the restraint device of FIG. 1;

DETAILED DESCRIPTION OF THE DRAWINGS

U.S. provisional patent application Ser. No. 61/458,044, filed Nov. 17, 2010, inventor and applicant Burt H. Shulman, is incorporated by reference herein in its entirety.

The following detailed description of one or more embodiments of the claimed invention, including the preferred embodiment, is intended to provide a full disclosure of the claimed invention to individuals skilled in the art.

Figure 1:
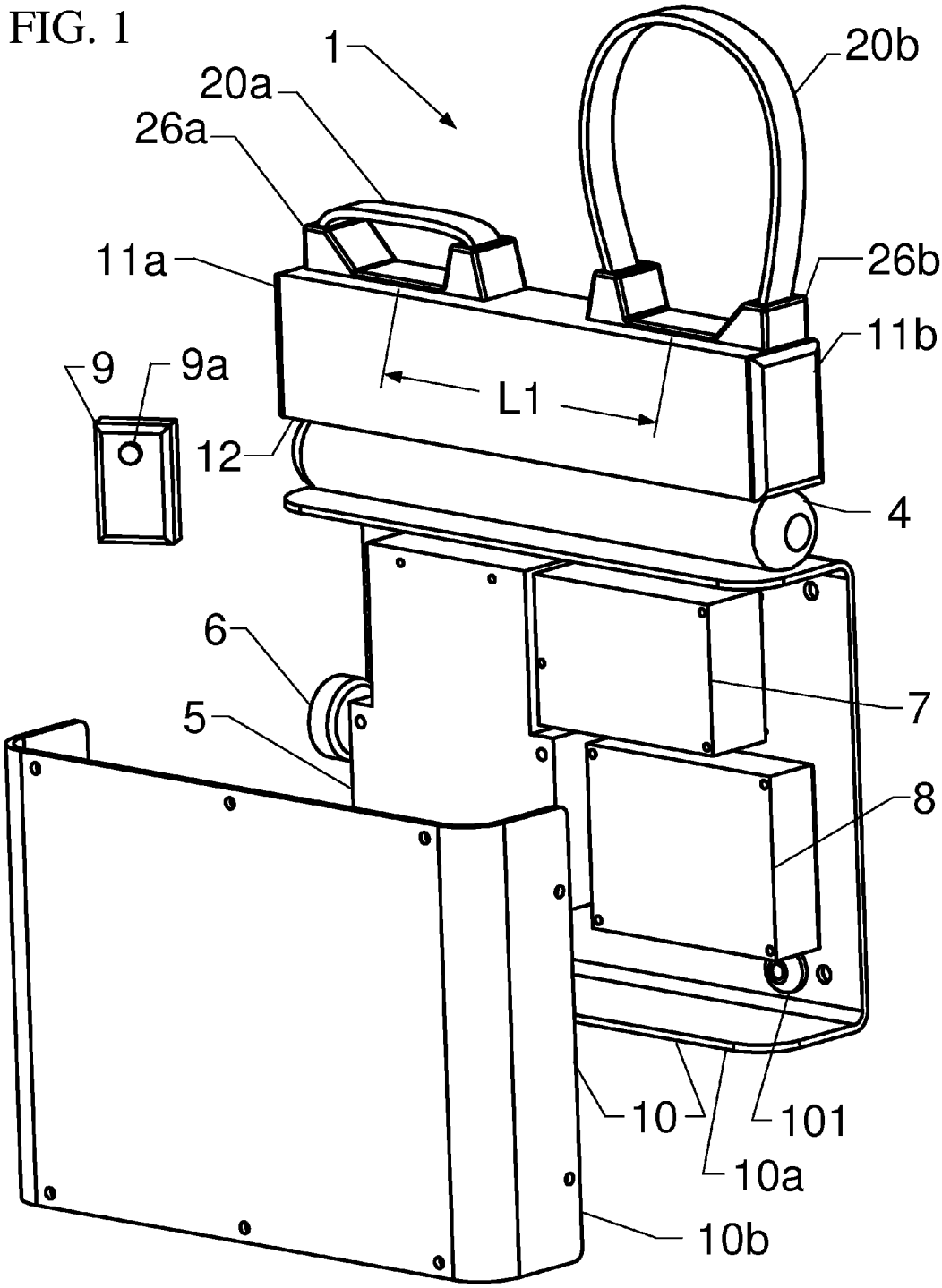
FIG. 1 is a front, right side, top perspective view of an outside of a restraint device in accordance with an embodiment of the present invention, wherein protective bellows and boots, are not shown; and an enclosure cover is opened to reveal internal components.

FIG. 1 shows a restraint device 1 in accordance with an embodiment of the present invention, wherein protective bellows 19*a* and 19*b* and their associated bottom portions i.e. boots are not shown, and an enclosure cover 10*b* is separated from the rest of the restraint device 1 to reveal some internal components of the restraint device 1.

The restraint device 1 includes bands 20*a* and 20*b*, each forming a loop. In a preferred embodiment of the present invention each of the bands 20*a* and 20*b* may be a timing belt. Timing belts are readily available in many lengths, widths, and tooth profiles. In this case, a timing belt, preferably fiberglass reinforced neoprene, with a width of 0.590 inch and a tooth profile known as "5 mm" (millimeter) Powergrip GT (trademarked) provides the needed characteristics, in at least one embodiment for each of bands 20*a* and 20*b*.

The restraint device 1 further includes receiving saddles 26*a* and 26*b*. Central locations of the wrist receiving saddles 26*a* and 26*b* may be separated by a distance of L1 which may be six to eight inches, which may be the typical separation between centers of wrists for known handcuffs. The restraint device 1, further includes a housing 12. The housing 12 provides mounting surfaces for one or more of electromechanical assemblies therein. In addition to this function, the housing structure 12 provides protection for these assemblies from externally applied forces, and providing an environmental barrier from environmental contaminants. The preferred embodiment for the housing of this structure 12 is an aluminum rectangular tube with a wall thickness which may range from 0.100 to 0.125 inches. The housing 12 may be closed at each end by commercially available plastic end caps, for the end caps 11*a* and 11*b*. End caps 11*a* and 11*b*, are attached to the housing 12, such that they can only be removed by service personnel.

The restraint device 1, further includes a tubular structure 4 located beneath the housing 12. The tubular structure 4 may be flexible and typically provides an adaptable mounting between the housing 12 and a power control enclosure base 10*a*. The tubular structure 4 is preferably made from fabric reinforced rubber tube, which provides flexibility to allow possible movement of a human being's suspect's arms and wrists, during restraint and sufficient strength to prevent the housing 12 from being separated from the power control enclosure base 10*a*, by a human suspect.

Included in the preferred embodiment of the restraint device 1 and located beneath the tubular structure 4, is a power control enclosure 10 in FIG. 1 which includes 10*a* and 10*b*, which may be clamshell shaped and which typically comprises a base portion 10*a* and a cover portion 10*b*. Said enclosure 10 provides protection for various electronic components mounted therein, from environmental contamination and external forces. The base portion 10*a*, also provides a mounting surface for the tubular structure 4, and provides a perpendicular mounting surface used to mount the restraint device 1 to a flat inner door panel replacement in, for instance, a police vehicle or automobile, such as vehicle 600 shown in FIG. 6. The structural strength of a clamshell shape for use for enclosure 10, when made preferably from about 0.125 inch thickness aluminum, is sufficient to maintain the attachment of the restraint device 1, to a vehicle door of an automobile, such as automobile or vehicle 600 in FIG. 6, under the external forces that may be imposed on it, by a suspect. A wire gland 101, shown in FIG. 1, is located on and penetrates through the enclosure base portion 10*a*, such that it can convey the various electrical wires and cables from the restraint device 1 into the interior of the rear door, of the vehicle 600, where said cables and wires may connect to the vehicle's electrical system. Another embodiment may provide an alternate mounting means and locate said enclosure and its internal components remotely from the housing 12.

The restraint device 1 further include a receiver 5, which may be a radio frequency (RF) radio receiver, mounted to the housing base portion 10*a*. The receiver 5 is used to link the restraint device 1 to a transmitter 9. The receiver 5, may be electrically connected to a radio antennae (not shown), which is typically mounted outside the power control enclosure 10 and situated for suitable reception of an RF control signal or other type of control signal such as optical, or sonic, from a transmitter 9.

The restraint device 1 further includes the transmitter 9, which may be a radio frequency (RF) radio transmitter, wherein the transmitter 9 may be a remote transmitter control which is activated by a control button 9*a*. Said transmitter 9 may be worn and operated by, for instance a law officer. The combination of said transmitter 9 and said receiver 5 provides a useful communication range of preferably, at least fifty feet.

The restraint device 1 further includes an audible alarm device 6. The audible alarm device 6, is typically controlled by and in communication with a microprocessor 8, and is provided to emit an audible confirmation, to a human operator, that the restraint device 1 is performing a restraint operation, a release operation or is malfunctioning, when a visual determination is not available.

Figure 2:
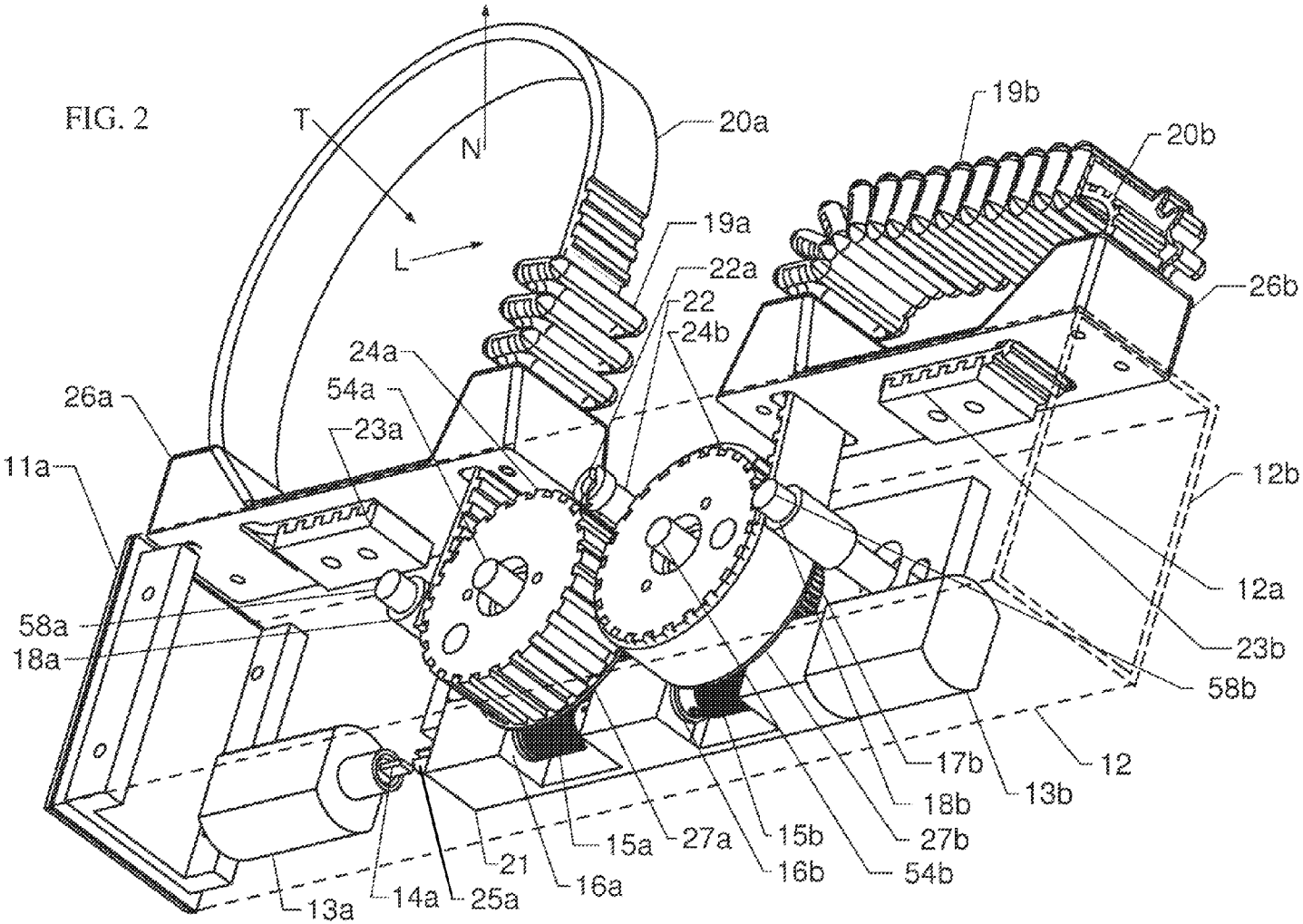
FIG. 2 is a front, bottom, right side perspective view of part of the restraint device of FIG. 1, and various internal subassemblies of the restraint device of FIG. 1, wherein a housing is shown transparently (by dotted lines), boots covering wrist receiving saddles and one end cap are not shown and a cut through view of one of the bellows to show inlying band is drawn.

The restraint device 1, of FIG. 1, further includes a power supply 7, mounted to the housing base portion 10*a*, that supplies a regulated voltage and limited current to drive motors 13*a* and 13*b*, shown in FIG. 2, for bidirectional motion of the motors 13*a* and 13*b*. The operation of the power supply 7 is typically controlled by the microprocessor 8.

The restraint device 1 further includes the computer processor or computer microprocessor 8, mounted to the housing base portion 10*a*. The microprocessor 8 may include a computer memory. The computer memory of the microprocessor 8 may include a stored computer program, which is executed by the microprocessor 8. In operation, when a momentary control signal, such as an RF control signal, from the transmitter 9, is received by the receiver 5, the microprocessor 8 is temporarily powered and program execution begins, latching power on from power supply 7, to the various circuits. In at least one embodiment, receiver 5 may be the only constantly powered component in the restraint device 1, so that quiescent power is kept to a low value of twenty milliamps, for the entire restraint device 1, to preserve a vehicle battery of an automobile, when the restraint device 1 is not in use. The restraint device 1, may be powered by power supply 7 which may be a vehicle or automobile battery, such as a battery of vehicle 600 of FIG. 6.

FIG. 2 shows part of the restraint device 1, with housing 12, shown as a transparent component (dotted lines), so that various inner components can be seen. Referring to FIG. 2, the restraint device 1, includes the motor 13*a*, the motor 13*b*, a tongued drive shaft 14*a* (for motor 13*a*, and there is also a tongued drive shaft for motor 13*b*, not shown), a worm 15*a*, a worm 15*b*, a bushing 16*a*, a bushing 16*b*, a worm wheel 17*b* (for reel 24*b*, and there is also a worm wheel 17*a*, not shown, for reel 24*a*), an idler roller 18*a*, an idler roller 18*b*, an axle 58*a*, an axle 58*b*, an axle 54*a*, an axle 54*b*, a bellows 19*a* (shown in part), a bellows 19*b* (shown cut through), a mounting plate 21, an emergency release cam 22, with a recess 22*a*, a chock 23*a*, a chock 23*b*, a reel 24*a* (with a flange 27*a* shown and opposing flange not shown), a reel 24*b* (with a flange 27*b* shown and opposing flange not shown), a grooved drive shaft 25*a* (for worm 15*a* and there is also a grooved drive shaft for worm 15*b*, not shown). FIG. 2 also includes a wrist receiving saddle 26*a*, a wrist receiving saddle 26*b* (both shown without their respective boot covering). FIG. 2 also shows, the band 20*a*, and the band 20*b*. In FIG. 2, the end cap 11*b* is not shown to reveal a front wall 12*a* and a rear wall 12*b* of housing 12.

In FIG. 2, the preferred embodiment of the restraint device 1, employs the bands 20*a* and 20*b*. In at least one embodiment, each of the bands 20*a* and 20*b* are flexible in the normal direction N (conformal), relatively non flexible in the transverse direction T, while providing high breaking strength and low stretch in the longitudinal direction L, shown in FIG. 2. Please note that each of the two bands 20*a* and 20*b* are driven and controlled in identical fashion, so that the description, below, pertains to both "sides" of the restraint device 1, whether explicitly stated or not. Band 20*a* is driven by motor 13*a* and band 20*b* is driven by a separate motor 13*b*, so that the band 20*a* is driven separately from the band 20*b*.

In at least one embodiment, it is preferred that motor 13*a* is a DC (direct current), permanent magnet, carbon brush, motor, having a rated stall torque, of about three in.-oz. at four volts direct current (vdc). The tongued motor drive shaft 14*a* is typically affixed to the grooved worm drive shaft or motor shaft 25*a* and engages with the grooved worm drive shaft 25*a*. This allows for minor misalignment between these parts. The drive shaft 25*a* spins in typical flanged bushings 16*a*, preferably made of Teflon (trademarked) and a second such bushing (not shown) located on the far end of the worm drive shaft 25*a*. Both the bushings 16*a* and the second set of bushings on the far end of the worm drive shaft 25*a* (second set of bushings not shown) receive radial and thrust loads, as the restraint operates. The worm 15*a* is typically locked to the drive shaft 25*a*. The worm 15*a* is preferably stainless steel, forty-eight pitch and has a 3.58 degree lead angle. Such a lead angle, creates a non-backdriveable gear train, to prevent motion, should forces, from the wrist, be applied to the band, in any direction.

The mounting plate 21 holds components parts 13*a*, 13*b*, 14*a* (and drive shaft for motor 13*b* not shown), 15*a*, 15*b*, 16*a*, 16*b* and 25*a* (and drive shaft, for worm 16*b*, not shown) in alignment and the mounting plate 21 is preferably made of steel. The mounting plate 21 is typically slideably mounted to the rear inner wall 12*b* of housing 12 by fasteners (not shown) and is mounted so to allow sliding in the vertical (normal, N) directions and minimal sliding in the horizontal (longitudinal) directions. Emergency release cam 22 extends between the walls of the housing 12. One end of cam 22 extends completely through the front housing wall 12*a*, while the other end of cam 22 rotates in a blind hole (not shown) in the rear wall 12*b*. The exposed end of the cam 22 has a recess 22*a*, which is shaped to receive and engage a standard handcuff key.

Emergency release cam 22 slides mounting plate 21 to two vertical positions: an engaged upper vertical position, and a disengaged lower vertical position. When the mounting plate 21 is a the engaged upper vertical position, as shown in FIG. 2, the worms 15*a* and 15*b*, the mounting plate 21 carries are properly meshed with their corresponding worm wheels 17*a* (not shown) and 17*b*. The worm wheel 17*a* or 17*b* rotates when the corresponding motor 13*a* or 13*b* rotates the worm 15*a* or 15*b* and cannot be rotated when the corresponding motor 13*a* or 13*b*, is not rotating. When the mounting plate 21 is in the disengaged lower vertical position, the worm wheel 17*a* or 17*b* is not meshed with the worm 15*a* or 15*b* and is free to rotate. This is the condition that allows the wrists to be manually released from the restraint device 1, should a malfunction occur.

Referring further to FIG. 2, the worm wheel 17*b*, preferably bronze, provides a 50:1 speed reduction, when driven by worm 15*b*. The worm wheel 17*b* is typically concentrically attached to the reel 24*b*, and is preferably an aluminum timing belt pulley with a mating tooth profile that matches the bands' tooth profile, as described above. The reel 24*a* is supported by radial bearings (not shown) and a stainless steel axle 54*a*, which extends through opposite walls 12*a* and 12*b* of the housing 12 (similarly, for reel 24*b* and axle 54*b*). One end of band 20*a* is attached to the circumference of the reel 24*a* at a location similar or identical to location 38*b* on reel 24*b*, shown in FIG. 3. Band 20*a* is then routed between Teflon (trademarked) idler roller 18*a*, which is supported by axle 58*a* (and similarly for band 20*b*, Teflon (trademarked) roller 18*b* and axle 58*b*) and the toothed circumference of the reel 24*a*. The idler roller 18*a*, in conjunction with the smooth side of band 20*a* allows the band 20*a* to be wound around the circumference of the reel 24*a*, when the reel 24*a* is driven, in a counterclockwise direction. More importantly, when unwinding band 20*a*, the arrangement of the idler roller 18*a* in contact with the smooth side of band 20*a*, and the toothed reel 24*a* in engagement with the toothed side of band 20*a*, provides sufficient directional stability and no relative slippage between the band and it's mating reel, as to extend band 20*a* and thus enlarge the loop even under encountered resisting forces.

Figures 4A, 4B, 4C:
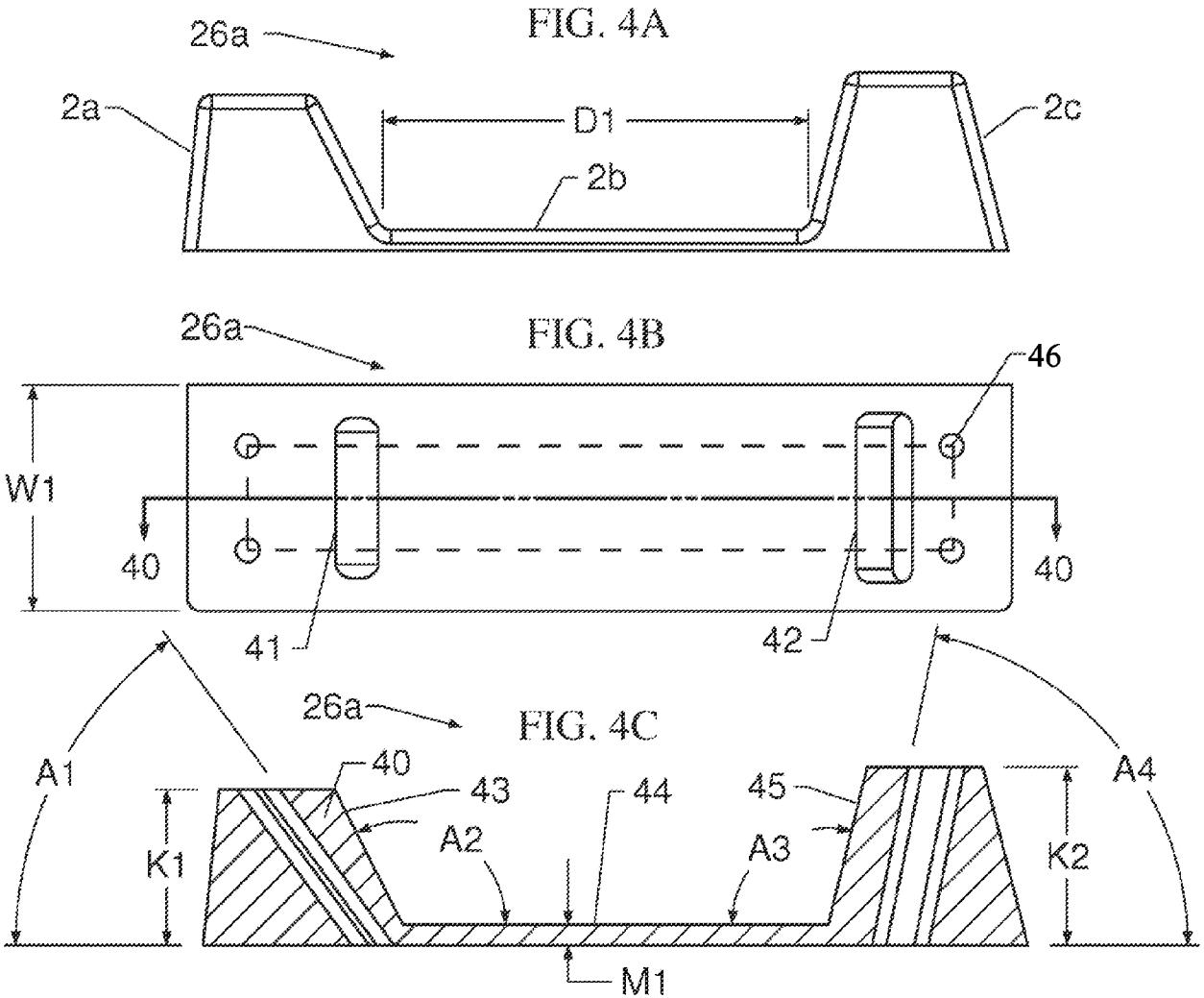
FIG. 4A is a front, elevational view of a wrist receiving saddle for use with the restraint device of FIG. 1.
FIG. 4B is a bottom, elevational view indicating a cross section of FIG. 4C, of the wrist receiving saddle of FIG. 4A for use with the restraint device of FIG. 1.
FIG. 4C is a cross sectional view of the wrist receiving saddle of FIG. 4A for use with the restraint device of FIG. 1.

The band 20*a*, after passing the idler roller 18*a*, is routed through an aperture (not shown) in the housing 12 and through a mating aperture 42 in wrist receiving saddle portion 2*c* in the wrist receiving saddle member 26*a*, said wrist receiving saddle being shown, in detail, in FIGS. 4A, 4B and 4C. The band 20*a* then is looped back to the wrist receiving saddle portion 2*a*, where the band 20*a* enters through aperture 41 and an aperture, in housing 12 (not shown) and is attached to the upper inner wall of the housing 12 by the chock 23*a*. The chock 23*a* is preferably steel and has a linear matching tooth profile to create a mounting, which is secure even at the band 20*a* (or 20*b*) breaking strength of one thousand lbsf (pounds of force).

The band 20*a* is protected from the environment by bellows 19*a*, shown in part, in FIG. 2. The bellows 19*a* is preferably neoprene with a wall thickness of preferably 0.018 inch. The configuration of the bellows 19*a* in conjunction with wall thickness and material selection, provides an environmental barrier, without introducing excessive resistance, to motion, during loop opening and closing, even when operating at thirty-two degrees Fahrenheit (F). The bellows 19*a* also has a boot portion, (not shown), which completely covers the wrist receiving saddle member 26*a* for optimal environmental contaminant resistance. Similarly, the bellows 19*b* has a boot portion (not shown), which completely covers the wrist receiving saddle member 26*b*.

Figure 3:
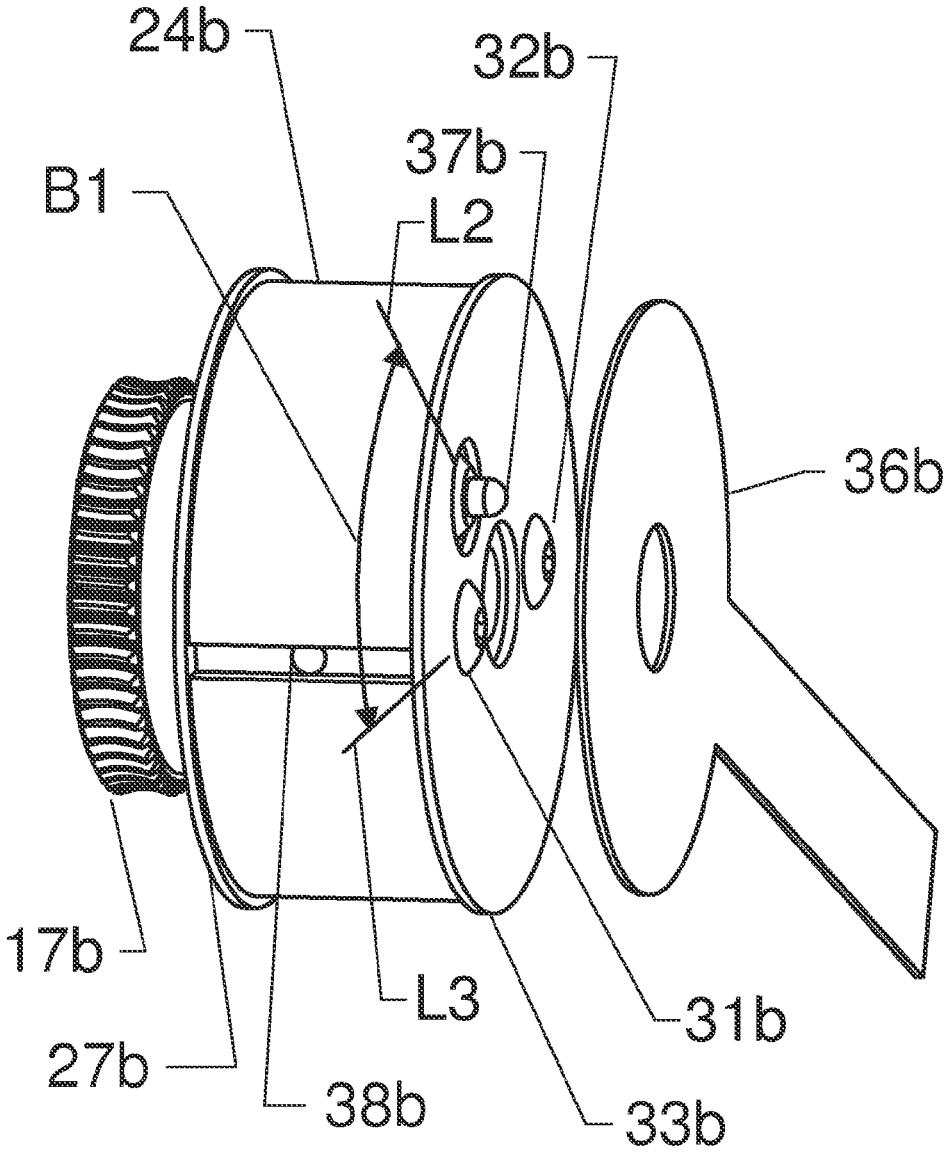
FIG. 3 is a detailed perspective view of a reel, flanges, wiper, worm wheel and absolute position encoder for use with the restraint device of FIG. 1.

FIG. 3 shows the reel 24*b*, the worm wheel 17*b*, an absolute position encoder 36*b*, reel flanges 27*b* and 33*b*, a band attachment hole 38*b*, and fasteners 31*b* and 32*b*, for use with the restraint device 1. The reel 24*b* includes a wiper 37*b*, which projects from reel 24*b* and has an angular location B1. The reel 24*a* would also include a worm wheel, similar to or identical to 17*b*, an encoder similar to or identical to 36*b*, and a wiper similar or identical to 37*b*, reel flanges similar to or identical to 27*b* and 33*b*, a band attachment hole similar or identical to 38*b*, and fasteners similar or identical to 31*b* and 32*b*. There would be a corresponding angular location of the wiper in reel 24*a*, similar or identical to angle B1 in reel 24*b*. The angle B1 is an angle between lines L2 and L3 and angle B1 is chosen so that when the band 20*b* is in a fully retracted position (wrapped around reel 24*b*), the wiper 37*b* contacts the absolute encoder 36*b*, such that the output of said encoder 36*b* is at a maximum (or minimum) value. A similar or identical configuration applies to band 20*a*, reel 24*a*, absolute encoder 36*a* and wiper 37*a*.

Further, referring to FIG. 3, absolute encoder 36*b* is arranged parallel to the front face of reel 24*b* and is attached to the front inner wall 12*a* of housing 12. The wiper 37*b*, attached to the reel 24*b*, mechanically contacts the absolute encoder 36*b* and thus the angular position of the reel 24*b* is converted to a varying resistance and can thus be interpreted by the microprocessor 8, shown in FIG. 8. The absolute encoder 36*b*, preferably a membrane potentiometer and its associated wiper 37*b*, are supplied by Hoffmann+Krippner (trademarked).

Referring now to FIGS. 4A, 4B, and 4C, the portions 2*a*, 2*b* and 2*c*, may form one wrist receiving saddle 26*a*. Portion 2*a* is separated from portion 2*c* by a distance D1, preferably two inches. The combination of portions similar or identical to 2*a*, 2*b* and 2*c*, and to the distance D1 may form a second wrist receiving saddle structure 26*b*. The wrist receiving saddle 26*a* thus formed provides a visual and tactile target for the suspect, in order to aid him in placing his wrists in a proper and safe position for restraint. Portion 2*b* provides such a target, as flat surface 44, upon which, the suspect's places the bottom of his wrist. In addition, the wrist receiving saddle structure 26*a* thus formed provides continued accurate lateral positioning for various sized wrists during restraint. The wrist receiving saddle 26*a* accomplishes this by employing side surfaces 43 and 45. Side 403 is canted outward, from the horizontal, at an angle A2, preferably about 117 degrees. Side 405 is canted outward, from the horizontal, at an angle A3, preferably about 104 degrees. In at least one embodiment these angular dimensions are critical to provide the proper comfort for human wrists of various sizes. Wrist receiving saddle 26*b* is a mirrored construction of wrist receiving saddle 26*a*.

The wrist receiving saddle 26*a*, includes a band passageway 41. Said passageway allows access to the interior of housing 12 (in conjunction with a mating aperture in housing 12, not shown) for the fixed end of band 20*a*. Said passageway is canted at angle A1, preferably about 54 degrees. The wrist receiving saddle 26*a*, includes band passageway 42. Said passageway is canted at angle A4, preferably about 78 degrees. Said passageway allows access to the interior of housing 12 (in conjunction with a mating aperture in housing 12, not shown) for the moving end of band 20*a*. Said outwardly canted passageways create a path between the said passageways for band 20*a*, such that said band forms a relatively circular loop shape, when in the extended position. The wrist receiving saddle 26*b* would also include band passageways similar or identical to 41 and 42 and mounting hole pattern similar or identical to mounting hole pattern 46. The wrist receiving saddles (such as the combination of portions 2*a*, 2*b*, 2*c*) are constructed from a rigid material, preferably aluminum.

Figures 5D, 5E:
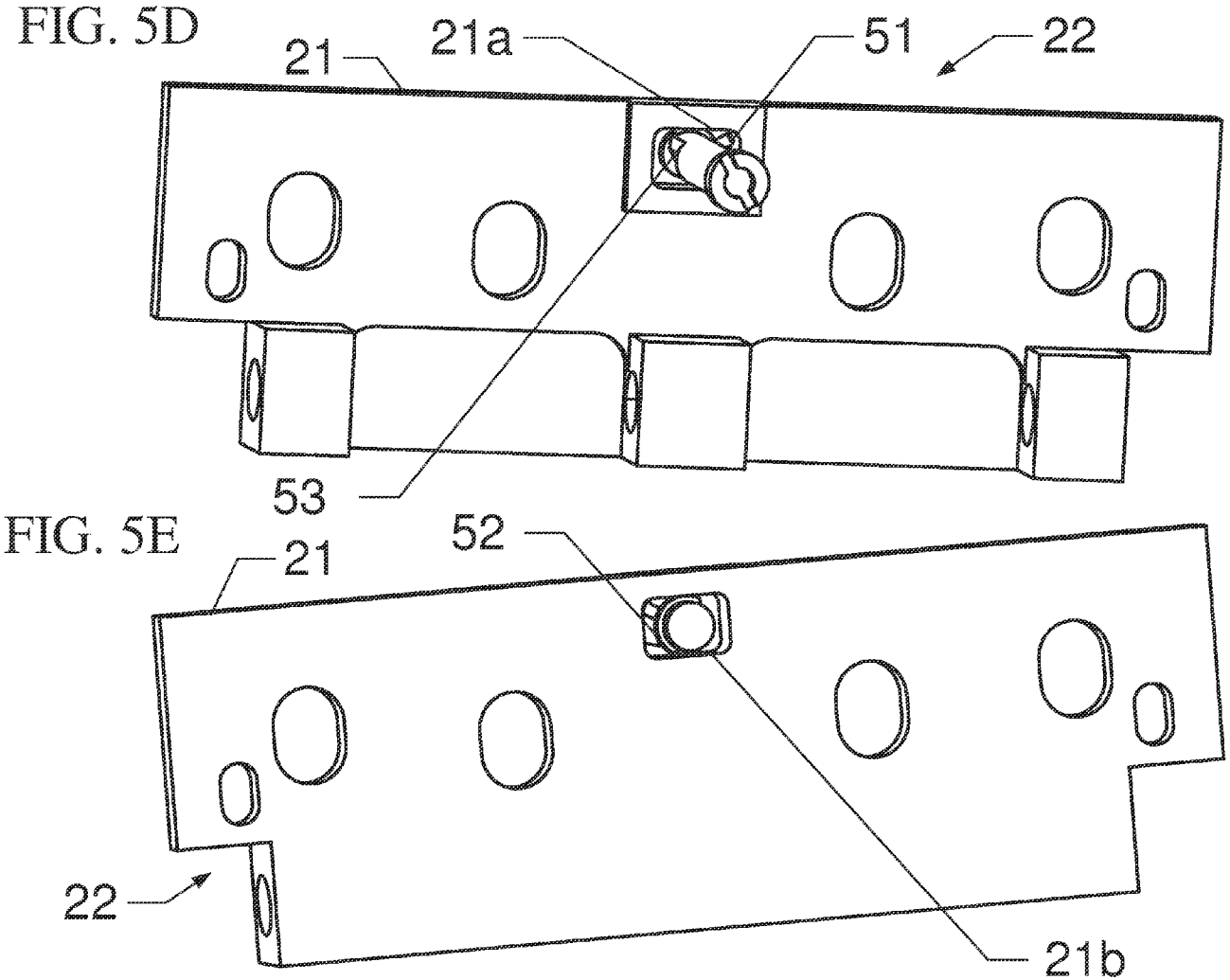
FIG. 5D is a front, perspective view of the emergency release cam of FIG. 5A, mounting plate and mounting plate aperture for use with the restraint device of FIG. 1.
FIG. 5E is a rear, perspective view of the emergency release cam of FIG. 5A, mounting plate and mounting plate aperture for use with the restraint device of FIG. 1.

Now referring to FIGS. 5A, 5B, 5C, 5D, and 5E, showing various views of the emergency release cam 22, the cam 22 travels through an aperture in mounting plate 21, which causes the mounting plate 21 to have a certain upper vertical position (engaged upper vertical position), within the housing 12 (not shown), when the mounting plate aperture upper wall 21*a* shown in FIG. 5D is supported by cam lobe 52 shown in FIG. 5E. When a standard handcuff key is inserted into recess 22*a* and the cam 22 is turned about sixty degrees, clockwise by the operator, the supporting cam lobe 52 moves, so it no longer supports the mounting plate 21. Mounting plate 21, is then forced to move to a certain lower vertical position (disengaged lower vertical position), by contact with pin 51, which pushes downward, on the mounting plate aperture lower wall 21*b*.

Figure 6:
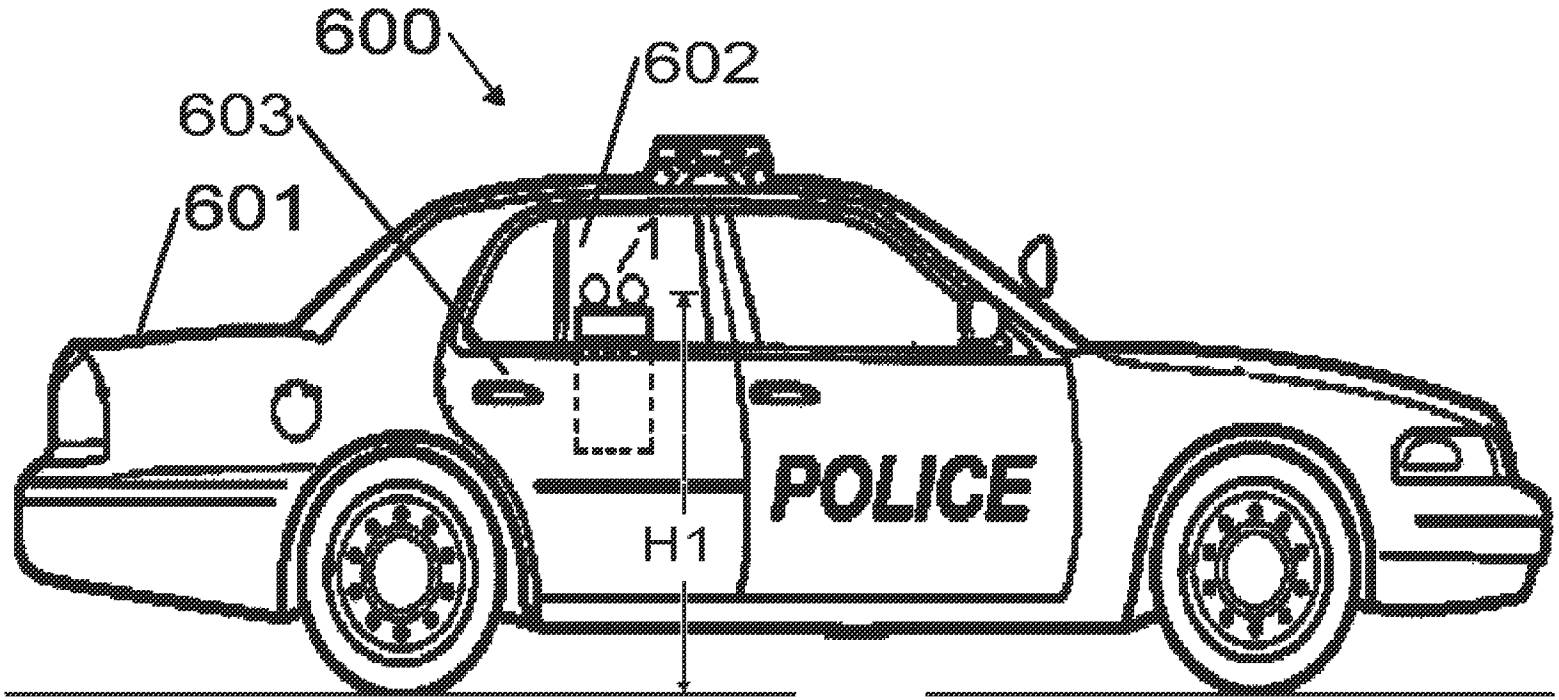
FIG. 6 is a side, elevational view of a preferred mounting position of the restraint device of FIG. 1 in a vehicle.
Figure 6A:
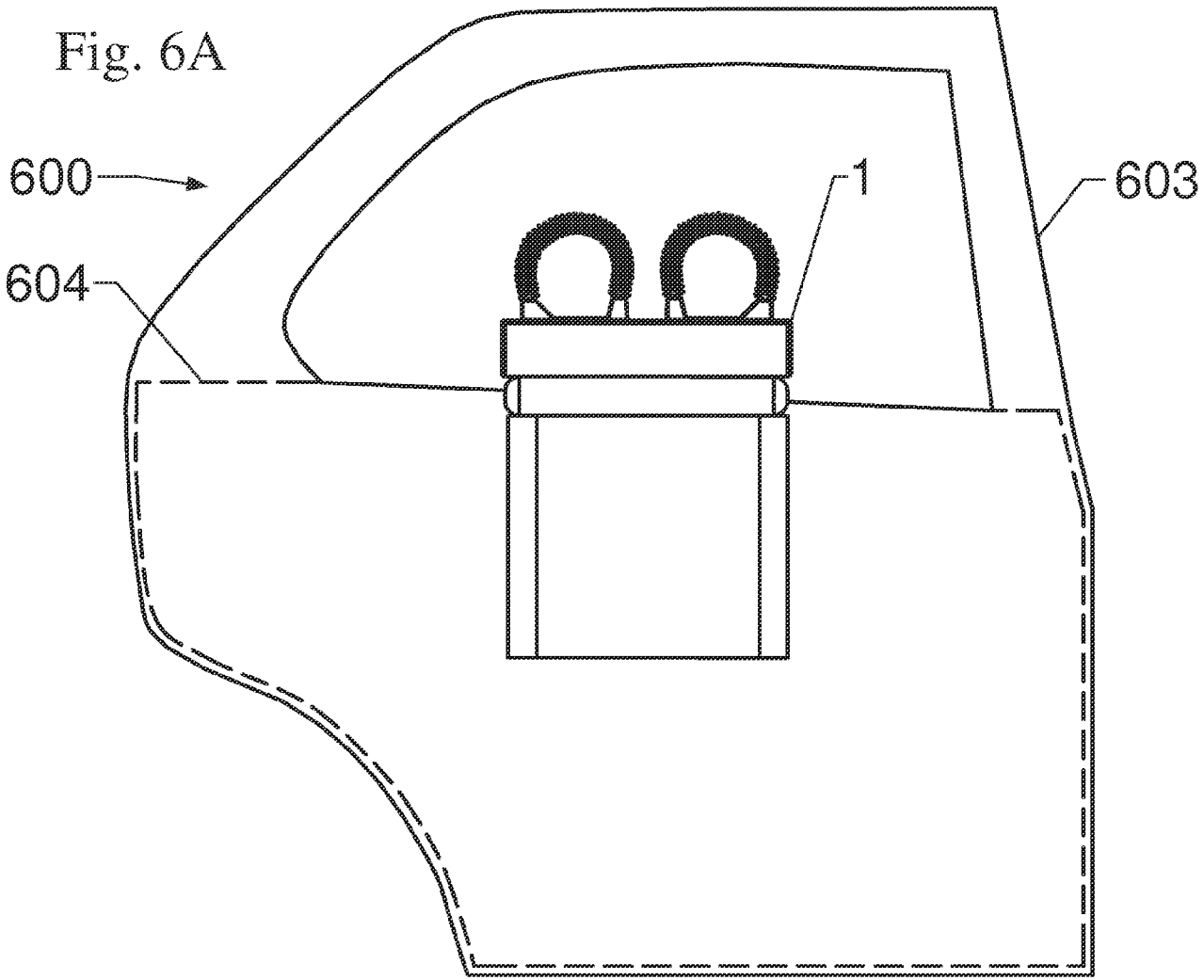
FIG. 6A is an elevational view of a preferred mounting position of the restraint device of FIG. 1 on a vehicle rear door.

FIG. 6 shows an apparatus 600, including a typical police vehicle 601, and the restraint device 1 mounted to a rear door 603 of the vehicle 601, preferably located on the inside of said door, as shown in FIG. 6A. The mounting position of the restraint device 1, inside the vehicle 601, protects the restraint device 1 from environmental contaminants such as water, snow, ice and mud. In addition, the temperature stability maintained inside the operating vehicle 601, facilitates the operation of the restraint device 1, during adverse temperature conditions outside the vehicle 601. Moreover, the mounting position shown in FIG. 6, locates the bands 20*a* and 20*b* of the restraint device 1, so they are accessible through the opened (electrically operated) vehicle window 602 and are at a height H1, preferably about thirty-three to thirty-seven inches, which facilitates entry of the suspect's wrists.

FIG. 6A, shows a view, from inside the vehicle, of an apparatus 600, including a typical police vehicle 601, and with the restraint device 1 mounted to the rear door 603, where a portion of said inside rear door, such as a fascia portion of a typical known automobile door, has been replaced by a flat replacement panel 604. The replacement panel 604 is preferably a commercially available steel panel produced by Havis Shields Equipment Corp. (trademarked).

Figure 7:
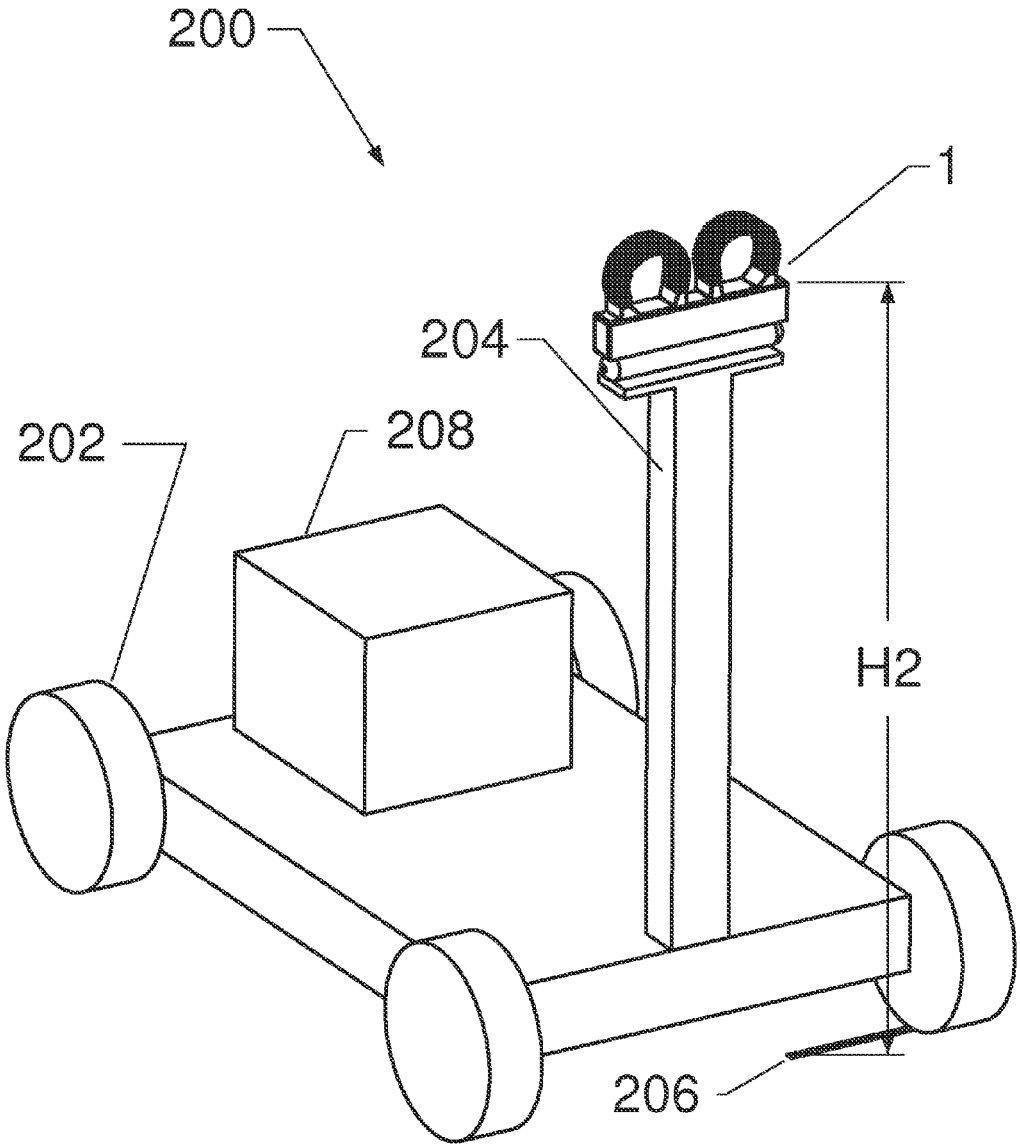
FIG. 7 is a perspective view of an apparatus including a robot and the restraint device of FIG. 1, with the restraint device mounted on the robot.

FIG. 7, in accordance with one or more embodiments of the present invention, shows an apparatus 200 including a robot, robotic platform or automated guided vehicle 202, with the restraint device 1 attached to a stalk member or post 204 which is fixed to the robot 202. The restraint device 1 has been shown with the power and control enclosure 10 (and internal components, all shown in FIG. 1) incorporated within the robot control system 208 in FIG. 7, but may be as previously described with reference to FIGS. 1-6. The stalk member 204 holds the restraint device 1 at a proper height for restraining the wrists of a suspect, who is in a standing position. For a typical adult suspect, the height H2, shown in FIG. 7 from a ground surface 206 may be preferably thirty-three to thirty-seven inches. These dimensions are considered critical in at least one embodiment of the present invention to provide a proper height for the restraint device 1. The stalk member or post 204 may be detachable from the robot 202 to allow the robot 202 to be easily transported. The electronic power and control system, for apparatus 100 shown in FIG. 8, not including the transmitter 9, may be integrated into the robot's existing systems. Typically, the transmitter 9 would be separate from the robot 202 and used to operate the restraint device 1 remotely. The transmitter 9 may not be considered part of the restraint device 1, in one or more embodiments, but rather may be considered to be controlling the restraint device 1. In other embodiments the transmitter 9 may be described as being part of the restraint device 1. In another embodiment, remote operation of the restraint device 1 may be implemented through the robot's existing communications link.

Figure 8:
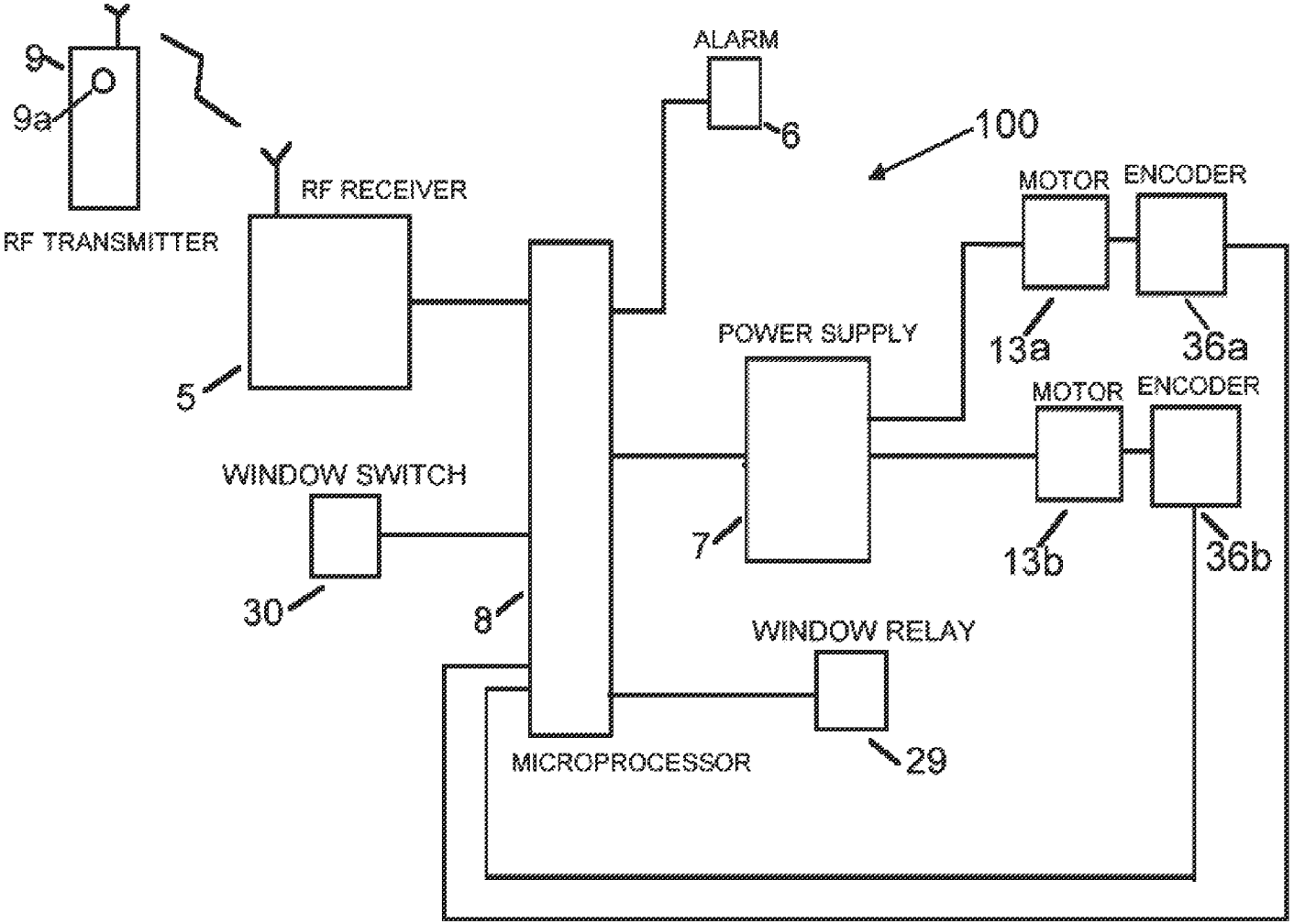
FIG. 8 is a block diagram of an apparatus for use with a power and control system, method, and apparatus of one or more embodiments of the present invention.

FIG. 8 is a block diagram of an apparatus 100 for use with a power and control system, apparatus, and method of one or more embodiments of the present invention. The apparatus 100 includes the receiver 5, the alarm device 6, the power supply 7, the processor or microprocessor 8, the transmitter 9, control button 9*a*, the motors 13*a* and 13*b*, the encoders 36*a* and 36*b*, a window relay 29, and a window switch 30. The microprocessor 8 may be electrically connected to, may communicate with, and may control receiver 5, transmitter 9, window switch 30, window relay 29, alarm 6, power supply 7, motors 13*a* and 13*b*, and encoders 36*a* and 36*b*. All actions of the microprocessor 8 are executed by a computer program, which resides in the microprocessor's memory, as is typical.

A restraint and release method of one or more embodiments of the present invention, such as a preferred embodiment starts, when a first control signal, such as a first RF transmission control signal is sent, such as by an operator depressing control button 9*a*. The control signal typically travels through the airwaves and is received by receiver 5 (typically as an RF received signal which may be the transmitted signal modified by noise and/or clutter). The received signal may be used by the microprocessor 8 to cause power to be applied to the microprocessor 8 from the power supply 7. In at least one embodiment, the microprocessor 8 is programmed by a computer program, to activate vehicle window relay 29 in response to the received control signal, opening an electrically operated vehicle window 602 (shown in FIG. 6). A state of "window open" is detected by, preferably a, magnetic switch 30, which communicates this to microprocessor 8 by another signal.

The microprocessor 8, is programmed by a computer program to send a signal to the power supply 7 to apply power to one motor, such as one of motors 13*a* or 13*b* to open the associated loop of either band 20*a* or 20*b*, in response to the signal from the magnetic switch 30. Loop position of either band 20*a* or 20*b* is monitored by the microprocessor 8 and when the particular loop is fully opened, as detected by one or more signals received by the microprocessor 8, power to the motors 13 or 13*b* is stopped by the microprocessor 8. The microprocessor 8 then opens the other loop (of either 20*a* or 20*b*), in a similar fashion. The microprocessor 8 then waits for the next control signal to be received by the receiver 5. During this wait time, while bands 20*a* and 20*b* are in an open state as shown in FIG. 6A, the officer commands the suspect to "place his hands through the loops of bands 20*a* and 20*b*, wrists down". He then depresses control button 9*a*, which by way of a similar chain of events, as described above, closes both loops of bands 20*a* and 20*b*, virtually simultaneously.

However, note that each band 20*a* and 20*b* is controlled and retracted separately by separate motors 13*a* and 13*b*. In order to accomplish virtually "simultaneous" closure of bands 20*a* and 20*b*, the microprocessor 8, is programmed to command the power supply 7 to drive both motors 13*a* and 13*b* in the closing direction, while monitoring the electrical representation of the loop positions as produced by the absolute encoders 36*a* and 36*b*. The loops of bands 20*a* and 20*b* continue to close, until each either contacts its respective human suspect wrist or until each reaches a full closed position (no wrist being present in a loop, shown in FIG. 1) for band 20*a*. During band closure, the microprocessor 8 monitors loop speed which is mathematically determined by the microprocessor 8 by applying a programmed mathematical formula to loop position information provided by absolute encoders 36*a* and 36*b* (described above). The mathematical formula may be stored in computer memory of the microprocessor 8 and may be a formula used in known control systems for determining generally the speed of a loop, which typically is proportional to the angular velocity, rotational velocity, or angular speed of the corresponding reel 24*a* or 24*b*. When wrist contact is made, the loop speed drops below a programmed threshold value, stored in computer memory of the microprocessor 8, and the microprocessor 8 senses this drop in speed, compares it to a stored threshold value and then power to that motor (of motors 13*a* and 13*b*) is stopped by the microprocessor 8. Alternatively, if the particular position encoder (of encoders 36*a* and 36*b*) provides a signal or signals to the microprocessor 8 to show the loop of band 20*a* or 20*b* to be at full closed position (no wrist present), power is stopped by the microprocessor 8 to that motor (of motors 13*a* and 13*b*).

When a loop of band 20*a* or 20*b* closes and is stopped from further movement by a wrist, the microprocessor 8 immediately and automatically reverses the corresponding drive motor (of 13*a* and 13*b*) at low speed and opens the particular loop a predetermined amount, based on a predetermined value stored in computer memory of the microprocessor. The resulting slack reduces contact forces on the person's wrist to nearly zero. Once the wrists are thus restrained, the next step in this restraint and release method of at least one or more embodiments of the present invention, is releasing the wrists. When the suspect's wrists are to be released from the restraint, the operator depresses control button 9*a*, which by way of a similar chain of events, as described above, causes the microprocessor 8, to delay activity for a certain specified amount of time, based on a predetermined value stored in computer memory of the microprocessor 8, such as preferably two seconds, in at least one embodiment, allowing the operator time to refocus his attention on the suspect. In this particular restraint and release method, after the delay, the microprocessor 8 is programmed to apply power to one of the motors 13*a* or 13*b*, opening the corresponding loop, releasing the suspect's corresponding wrist. During a loop opening step, the microprocessor 8 monitors the position of the band, in a manner similar to that described above and stops power to the corresponding motor, when the loop is fully opened, as shown in FIG. 1 for band 20*b*. The operator is then able to place the free wrist, brought behind the suspect, into a standard handcuff. The operator then depresses control button 9*a* for the last time in this restraint and release method of at least one or more embodiments of the present invention, which by way of a similar chain of events, as described above, causes microprocessor 8, to respond by similarly delaying activity and then opening the other loop, to release the suspect's other wrist for similar placement into the standard handcuff. After all the above steps are completed, the microprocessor 8, is programmed to close the loops, after a predetermined time, preferably fifteen seconds, which may be determined by a value stored in computer memory of the microprocessor. The microprocessor 8, then depowers itself, to reduce quiescent power requirements.

Each time the officer depresses button 9*a* and before each step of a restraint and release method performed by the restraint device 1, in at least one embodiment, the microprocessor 8 activates an audible alarm 6 and an audible alert is issued to confirm reception of a control signal from the transmitter 9 received by receiver 5, and indicates impending restraint device 1 action. Additionally, the microprocessor 8, may be programmed to detect various fault conditions during each step in the operation of the restraint device 1 and also to perform fault testing before the initiation of any restraint device 1 action. For instance, loop closure or opening of bands 20*a* or 20*b* is normally performed in about five hundred milliseconds. If this time is exceeded, due to a fault, in at least one embodiment, the microprocessor 8 interrupts power to the motors 13*a* and 13*b* immediately and activates audible alarm 6, to alert the remotely located operator of a fault, so that he may take immediate remedial action to prevent injury to the suspect.

Many other restraint and release methods may be envisioned, utilizing the programming flexibility and adaptability of the microprocessor 8. Thus, specific embodiments of a conformal automated wrist restraint apparatus and method have been disclosed. It should be apparent, however, to those skilled in the art that many more modifications, besides those already described, are possible without departing from the inventive concepts herein. The inventive subject matter, therefore, is not to be restricted except in the spirit of the disclosure. Moreover, in interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising a first motor;

a second motor;

a first band;

a second band;

a first housing;

a first reel;

a second reel;

wherein the first band has a first end and a second opposing end;

wherein the first end of the first band is attached to the first reel;

wherein the second end of the first band is fixed to the first housing;

wherein the second band has a first end and a second opposing end;

wherein the first end of the second band is attached to the second reel;

wherein the second end of the second band is fixed to the first housing;

wherein the first band passes through a first opening and a second opening in the first housing, such that the first opening in the first housing is spaced apart from the second opening in the first housing;

wherein the second band passes through a third opening and a fourth opening in the first housing, such that the third opening in the first housing is spaced apart from the fourth opening in the first housing;

wherein the first band is connected to the first motor so that the first band forms a first loop;

wherein the second band is connected to the second motor so that the second band forms a second loop;

wherein the first motor and the second motor are fixed to the first housing;

wherein the first band is connected to the first motor so that the first loop is adaptable to be varied by the first motor without varying the second loop;

wherein the first motor is configured to wind at least part of the first band around the first reel when the first motor rotates the first reel in a first direction to thereby cause the first loop to be reduced in size, while the first end of the first band remains attached to the first reel and the second end of the first band remains fixed to the first housing so that if the first housing does not move, the second end of the first band does not move;

wherein the first motor is configured to unwind at least part of the first band from the first reel when the first motor rotates the first reel in a second direction which is opposite the first direction, to thereby cause the first loop to be increased in size, while the first end of the first band remains attached to the first reel and the second end of the first band remains fixed to the first housing so that if the first housing does not move, the second end of the first band does not move;

wherein the second band is connected to the second motor so that the second loop is adaptable to be varied by the second motor without varying the first loop;

wherein the second motor is configured to wind at least part of the second band around the second reel when the second motor rotates the second reel in a third direction, to thereby cause the second loop to be reduced in size, while the first end of the second band remains attached to the second reel and the second end of the second band remains fixed to the first housing so that if the first housing does not move, the second end of the second band does not move; and wherein the second motor is configured to unwind at least part of the second band from the second reel when the second motor rotates the second reel in a fourth direction which is opposite the third direction, to thereby cause the second loop to be increased in size, while the first end of the second band remains attached to the second reel and the second end of the second band remains fixed to the first housing so that if the first housing does not move, the second end of the second band does not move.

2. The apparatus of claim 1 further comprising a computer processor which is programmed to control the first motor and the second motor.

3. The apparatus of claim 1 further comprising a transmitter;

a receiver;

wherein the receiver is fixed to the first housing;

wherein the receiver communicates with the first motor;

and wherein the receiver is configured to receive a first received control signal due to a first transmitted control signal transmitted from the transmitter; and wherein the first motor is configured to be controlled to cause varying of the first loop without varying of the second loop by the first received control signal.

4. The apparatus of claim 3 wherein the receiver is configured to receive a second received control signal due to a second transmitted control signal transmitted from the transmitter; and wherein the second motor is configured to be controlled to cause varying of the second loop without varying of the first loop by the second received control signal.

5. The apparatus of claim 3 wherein the transmitter is a radio frequency transmitter; and the receiver is a radio frequency receiver.

6. The apparatus of claim 1 further comprising a device for controlling the first motor;

a device for controlling the second motor;

wherein the device for controlling the first motor causes the first reel to be rotated in the first direction to cause the first loop to decrease in size in response to a first command until a first criteria is satisfied and when the first criteria is satisfied the first motor causes the first reel to be rotated in the second direction, opposite the first direction, to cause the first loop to be increased in size a first predetermined amount; and wherein the device for controlling the second motor causes the second reel to be rotated in the third direction to cause the second loop to decrease in size in response to a second command until a second criteria is satisfied and when the second criteria is satisfied the second motor causes the second reel to be rotated in the fourth direction, opposite the third direction, to cause the second loop to be increased in size a second predetermined amount.

7. The apparatus of claim 1 wherein the first reel has a perimeter and a first plurality of teeth on its perimeter;

the second reel has a perimeter and a second plurality of teeth on its perimeter;

wherein the first band has an exterior and a third plurality of teeth on its exterior;

wherein the second band has an exterior and a fourth plurality of teeth on its exterior;

wherein the first plurality of teeth of the first reel interlock with the third plurality of teeth of the first band;

wherein the second plurality of teeth of the second reel interlock with the fourth plurality of teeth of the second band;

and wherein rotation of the first reel in the second direction causes the first loop to extend further beyond the first housing, and rotation of the first reel in the first direction, opposite the second direction, causes the first loop to retract closer to the first housing;

and wherein rotation of the second reel in the fourth direction causes the second loop to extend further beyond the first housing, and rotation of the second reel in the third direction, opposite the fourth direction, causes the second loop to retract closer to the first housing.

8. The apparatus of claim 1 further comprising a first device for indicating a first angular orientation of the first reel; and a second device for indicating a second angular orientation of the second reel;

and a computer processor which is configured to receive a first input from the first device for indicating the first angular orientation of the first reel and a second input from the second device for indicating the second angular orientation of the second reel;

wherein the computer processor is programmed to control whether the first motor increases the size of the first loop or decreases the size of the first loop based on the first input from the first device for indicating the first angular orientation of the first reel;

and wherein the computer processor is programmed to control whether the second motor increases the size of the second loop or decreases the size of the second loop based on the second input from the second device for indicating the second angular orientation of the second reel.

9. The apparatus of claim 1 further comprising a second housing; and a flexible tube mounting member;

wherein the flexible tube mounting member connects the first housing to the second housing;

wherein the first opening, the second opening, the third opening, and the fourth opening are spaced apart from each other along a first line, wherein the first line starts at the first opening, the second opening follows the first opening along the first line, the third opening follows the second opening along the first line, and the fourth opening follows the third opening along the first line, and the first line ends at the fourth opening; and wherein the flexible tube mounting member connects the first housing to the second housing along a second line, which is substantially parallel to the first line and which has a length which is approximately equal to a length of the first line and the flexible tube mounting member is configured to allow the first housing to flex with respect to the second housing along the second line.

10. The apparatus of claim 1 further comprising a second housing; and a flexible tube mounting member;

wherein the flexible tube mounting member connects the first housing to the second housing, such that when the second housing is fixed so that the second housing does not move, the first housing can flex with respect to the second housing; and wherein the second housing includes a computer processor which is programmed to control whether the first motor increases the size of the first loop or decreases the size of the first loop and whether the second motor increases the size of the second loop or decreases the size of the second loop.

11. The apparatus of claim 1 further comprising an emergency release cam which is configured to be manually moved by a user to a first position which allows the first loop of the first band to be increased in size without the use of the first motor, and which allows the second loop of the second band to be increased in size without the use of the second motor;

and wherein the emergency release cam is configured to be manually moved by a user to a second position which does not allow the first loop of the first band to be increased in size without the use of the first motor, and which does not allow the second loop of the second band to be increased in size without the use of the second motor.

12. The apparatus of claim 7 further comprising a first idler roller; and a second idler roller;

wherein at least part of the first band passes between the first reel and the first idler roller;

wherein at least part of the second band passes between the second reel and the second idler roller;

wherein the first idler roller is located with respect to the first reel so that the first idler roller contacts the at least part of the first band and so that one or more teeth of the third plurality of teeth of the first band are between the first idler roller and the first reel and are engaged with one or more teeth of the first plurality of teeth of the first reel, while the first loop of the first band is being increased or decreased in size by the rotation of the first reel; and wherein the second idler roller is located with respect to the second reel so that the second idler roller contacts the at least part of the second band and so that one or more teeth of the fourth plurality of teeth of the second band are between the second idler roller and the second reel and are engaged with one or more teeth of the second plurality of teeth of the second reel, while the second loop of the second band is being increased or decreased in size by the rotation of the second reel.

13. An apparatus comprising a first motor;

a second motor;

a first band;

a second band;

a first housing;

wherein the first band has a width, a thickness, and a length, wherein the width of the first band is substantially greater than the thickness of the first band and the length of the first band is substantially greater than the width of the first band;

wherein the first band is substantially flexible in a direction parallel to the thickness of the first band;

wherein the first band is substantially inflexible in a direction parallel to the width of the first band;

wherein the second band has a width, a thickness, and a length, wherein the width of the second band is substantially greater than the thickness of the second band, and the length of the second band is substantially greater than the width of the second band;

wherein the second band is substantially flexible in a direction parallel to the thickness of the second band;

wherein the second band is substantially inflexible in a direction parallel to the width of the second band;

wherein the first band is connected to the first motor so that the first band forms a first loop;

wherein the second band is connected to the second motor so that the second band forms a second loop;

wherein the first motor and the second motor are fixed to the first housing;

wherein the first band is connected to the first motor so that the first loop is adaptable to be varied by the first motor without varying the second loop; and wherein second band is connected to the second motor so that the second loop is adaptable to be varied by the second motor without varying the first loop; and further comprising a first wrist receiving saddle fixed to the first housing;

a second wrist receiving saddle fixed to the first housing;

wherein the first wrist receiving saddle and the second wrist receiving saddle are spaced apart along a line;

wherein a first end of the first band is inserted through a first end of the first wrist receiving saddle and a second end of the first band is inserted through a second end of the first wrist receiving saddle;

wherein a first end of the second band is inserted through a first end of the second wrist receiving saddle and a second end of the second band is inserted through a second end of the second wrist receiving saddle; and wherein the first motor is configured to vary the first loop and the second motor is configured to vary the second loop so that a first wrist of an individual can be inserted into a first space bounded by the first band and the first wrist receiving saddle, while a second wrist of the individual can be inserted into a second space bounded by the second band and the second wrist receiving saddle;

wherein the first band is configured in the apparatus such that the first band has a uniform structure in a first area defined by the first loop, regardless of how the first loop is varied by the first motor; and wherein the second band is configured in the apparatus such that the second band has a uniform structure in a second area defined by the second loop, regardless of how the second loop is varied by the second motor.

14. A method comprising inserting an individual's right wrist into a first space bounded by a first loop and a first wrist receiving saddle of a restraint device;

inserting the individual's left wrist into a second space bounded by a second loop and a second wrist receiving saddle of the restraint device;

wherein the restraint device comprises:

a first motor;

a second motor;

a first band;

a second band;

a first housing;

a first reel;

a second reel;

wherein the first band has a first end and a second opposing end;

wherein the first end of the first band is attached to the first reel;

wherein the second end of the first band is fixed to the first housing;

wherein the second band has a first end and a second opposing end;

wherein the first end of the second band is attached to the second reel;

wherein the second end of the second band is fixed to the first housing;

wherein the first band passes through a first opening and a second opening in the first housing, such that the first opening in the first housing is spaced apart from the second opening in the first housing;

wherein the second band passes through a third opening and a fourth opening in the first housing, such that the third opening in the first housing is spaced apart from the fourth opening in the first housing;

wherein the first band is connected to the first motor so that the first band forms the first loop;

wherein the second band is connected to the second motor so that the second band forms the second loop;

wherein the first motor and the second motor are fixed to the first housing;

wherein the first band is connected to the first motor so that the first loop is adaptable to be varied by the first motor without varying the second loop;

wherein the first motor is configured to wind at least part of the first band around the first reel when the first motor rotates the first reel in a first direction to thereby cause the first loop to be reduced in size, while the first end of the first band remains attached to the first reel and the second end of the first band remains fixed to the first housing so that if the first housing does not move, the second end of the first band does not move;

wherein the first motor is configured to unwind at least part of the first band from the first reel when the first motor rotates the first reel in a second direction which is opposite the first direction, to thereby cause the first loop to be increased in size, while the first end of the first band remains attached to the first reel and the second end of the first band remains fixed to the first housing so that if the first housing does not move, the second end of the first band does not move;

wherein the second band is connected to the second motor so that the second loop is adaptable to be varied by the second motor without varying the first loop;

wherein the second motor is configured to wind at least part of the second band around the second reel when the second motor rotates the second reel in a third direction, to thereby cause the second loop to be reduced in size, while the first end of the second band remains attached to the second reel and the second end of the second band remains fixed to the first housing so that if the first housing does not move, the second end of the second band does not move; and wherein the second motor is configured to unwind at least part of the second band from the second reel when the second motor rotates the second reel in a fourth direction which is opposite the third direction, to thereby cause the second loop to be increased in size, while the first end of the second band remains attached to the second reel and the second end of the second band remains fixed to the first housing so that if the first housing does not move, the second end of the second band does not move.

15. The method of claim 14 wherein the restraint device further comprises a computer processor which is programmed to control the first motor and the second motor.

16. The method of claim 14 wherein the restraint device further comprises:

a transmitter; and a receiver;

wherein the receiver is fixed to the first housing;

wherein the receiver communicates with the first motor;

and wherein the receiver is configured to receive a first received control signal due to a first transmitted control signal transmitted from the transmitter; and wherein the first motor is configured to be controlled to cause varying of the first loop without varying of the second loop by the first received control signal.

17. The method of claim 16 wherein the receiver is configured to receive a second received control signal due to a second transmitted control signal transmitted from the transmitter; and wherein the second motor is configured to be controlled to cause varying of the second loop without varying of the first loop by the second received control signal.

18. The method of claim 16 wherein the transmitter is a radio frequency transmitter; and the receiver is a radio frequency receiver.

19. The method of claim 14 wherein the restraint device is further comprised of:

a device for controlling the first motor;

a device for controlling the second motor;

wherein the device for controlling the first motor causes the first reel to be rotated in the first direction to cause the first loop to decrease in size in response to a first command until a first criteria is satisfied and when the first criteria is satisfied the first motor causes the first reel to be rotated in the second direction, opposite the first direction, to cause the first loop to increase in size a first predetermined amount; and wherein the device for controlling the second motor causes the second reel to be rotated in the third direction to cause the second loop to decrease in size in response to a second command until a second criteria is satisfied and when the second criteria is satisfied the second motor causes the second reel to be rotated in the fourth direction, opposite the third direction, to cause the second loop to increase in size a second predetermined amount.

20. The method of claim 14 wherein the first reel has a perimeter and a first plurality of teeth on its perimeter;

the second reel has a perimeter and a second plurality of teeth on its perimeter;

wherein the first band has an exterior and a third plurality of teeth on its exterior;

wherein the second band has an exterior and a fourth plurality of teeth on its exterior;

wherein the first plurality of teeth of the first reel interlock with the third plurality of teeth of the first band;

wherein the second plurality of teeth of the second reel interlock with the fourth plurality of teeth of the second band;

and wherein rotation of the first reel in a first direction causes the first loop to extend further beyond the first housing, and rotation of the first reel in a second direction, opposite the first direction, causes the first loop to retract closer to the first housing; and and wherein rotation of the second reel in a third direction causes the second loop to extend further beyond the first housing, and rotation of the second reel in a fourth direction, opposite the third direction, causes the second loop to retract closer to the first housing.

21. The method of claim 14 wherein the restraint device further comprises:

a first device for indicating a first angular orientation of the first reel;

a second device for indicating a second angular orientation of the second reel;

and a computer processor which is configured to receive a first input from the first device for indicating the first angular orientation of the first reel and a second input from the second device for indicating the second angular orientation of the second reel;

wherein the computer processor is programmed to control whether the first motor increases the size of the first loop or decreases the size of the first loop based on the first input from the first device for indicating the first angular orientation of the first reel;

and wherein the computer processor is programmed to control whether the second motor increases the size of the second loop or decreases the size of the second loop based on the second input from the second device for indicating the second angular orientation of the second reel.

22. The method of claim 14 wherein the restraint device further comprises a second housing; and a flexible tube mounting member;

wherein the flexible tube mounting member connects the first housing to the second housing; and further comprising fixedly mounting the second housing to a vehicle, so that the first housing can flex with respect to the second housing via the flexible tube mounting member, while the second housing remains fixed to the vehicle and the vehicle remains stationary; and wherein the second housing includes a computer processor which is programmed to control whether the first motor increases the size of the first loop or decreases the size of the first loop and whether the second motor increases the size of the second loop or decreases the size of the second loop.

23. The method of claim 14 wherein the restraint device further comprises a second housing; and a flexible tube mounting member;

wherein the flexible tube mounting member connects the first housing to the second housing;

wherein the first opening, the second opening, the third opening, and the fourth opening are spaced apart from each other along a first line, wherein the first line starts at the first opening, the second opening follows the first opening along the first line, the third opening follows the second opening along the first line, and the fourth opening follows the third opening along the first line, and the first line ends at the fourth opening; and wherein the flexible tube mounting member connects the first housing to the second housing along a second line, which is substantially parallel to the first line and which has a length which is approximately equal to a length of the first line and the flexible tube mounting member is configured to allow the first housing to flex with respect to the second housing along the second line;

and further comprising fixedly mounting the second housing to a vehicle, so that the first housing can flex with respect to the second housing via the flexible tube mounting member, while the second housing remains fixed to the vehicle and the vehicle remains stationary.

24. A method comprising inserting an individual's right wrist into a first space bounded by a first loop and a first wrist receiving saddle of a restraint device;

inserting the individual's left wrist into a second space bounded by a second loop and a second wrist receiving saddle of the restraint device;

wherein the restraint device comprises:

a first motor;

a second motor;

a first band;

a second band;

a first housing;

wherein the first band has a width, a thickness, and a length, wherein the width of the first band is substantially greater than the thickness of the first band and the length of the first band is substantially greater than the width of the first band;

wherein the first band is substantially flexible in a direction parallel to the thickness of the first band;

wherein the first band is substantially inflexible in a direction parallel to the width of the first band;

wherein the second band has a width, a thickness, and a length, wherein the width of the second band is substantially greater than the thickness of the second band, and the length of the second band is substantially greater than the width of the second band;

wherein the second band is substantially flexible in a direction parallel to the thickness of the second band;

wherein the second band is substantially inflexible in a direction parallel to the width of the second band;

wherein the first band is connected to the first motor so that the first band forms the first loop;

wherein the second band is connected to the second motor so that the second band forms the second loop;

wherein the first motor and the second motor are fixed to the first housing;

wherein the first band is connected to the first motor so that the first loop is adaptable to be varied by the first motor without varying the second loop;

wherein the second band is connected to the second motor so that the second loop is adaptable to be varied by the second motor without varying the first loop;

wherein the first wrist receiving saddle is fixed to the first housing;

wherein the second wrist receiving saddle is fixed to the first housing;

wherein the first wrist receiving saddle and the second wrist receiving saddle are spaced apart along a line;

wherein a first end of the first band is inserted through a first end of the first wrist receiving saddle and a second end of the first band is inserted through a second end of the first wrist receiving saddle;

wherein a first end of the second band is inserted through a first end of the second wrist receiving saddle and a second end of the second band is inserted through a second end of the second wrist receiving saddle; and wherein the first motor is configured to vary the first loop and the second motor is configured to vary the second loop so that a first wrist of an individual can be inserted into a first space bounded by the first band and the first wrist receiving saddle, while a second wrist of the individual can be inserted into a second space bounded by the second band and the second wrist receiving saddle;

wherein the first band is configured in the restraint device such that the first band has a uniform structure in a first area defined by the first loop, regardless of how the first loop is varied by the first motor; and wherein the second band is configured in the restraint device such that the second band has a uniform structure in a second area defined by the second loop, regardless of how the second loop is varied by the second motor.

* * * * *